US010415831B2

(12) United States Patent
Hoffman et al.

(10) Patent No.: US 10,415,831 B2
(45) Date of Patent: Sep. 17, 2019

(54) COMBUSTOR ASSEMBLY WITH MOUNTED AUXILIARY COMPONENT

(71) Applicant: General Electric Company, Schenectady, NY (US)

(72) Inventors: Seth Reynolds Hoffman, Spartanburg, SC (US); Richard Martin DiCintio, Simpsonville, SC (US); Elizabeth Angelyn Monaghan, Greenville, SC (US)

(73) Assignee: General Electric Company, Schenectady, NY (US)

( * ) Notice: Subject to any disclaimer, the term of this patent is extended or adjusted under 35 U.S.C. 154(b) by 384 days.

(21) Appl. No.: 15/335,538

(22) Filed: Oct. 27, 2016

(65) Prior Publication Data

US 2018/0119958 A1 May 3, 2018

(51) Int. Cl.

| | |
|---|---|
| ***F23R 3/28*** | (2006.01) |
| ***F23M 5/00*** | (2006.01) |
| ***F23R 3/00*** | (2006.01) |
| ***F23R 3/34*** | (2006.01) |
| ***F23R 3/60*** | (2006.01) |

(52) U.S. Cl.

CPC ..... *F23R 3/283* (2013.01); *F23M 5/00* (2013.01); *F23R 3/002* (2013.01); *F23R 3/346* (2013.01); *F23R 3/60* (2013.01); *F23D 2211/00* (2013.01); *F23R 2900/00005* (2013.01)

(58) Field of Classification Search

CPC ..... F23R 3/002; F23R 3/283; F23R 3/346; F23R 3/60; F05D 2240/35; F23M 5/00

See application file for complete search history.

(56) References Cited

U.S. PATENT DOCUMENTS

| | | | | |
|---|---|---|---|---|
| 2,538,642 A * | 1/1951 | Gardiner | ..... | F02C 7/262 136/209 |
| 3,048,015 A * | 8/1962 | Barrelle | ..... | F02C 7/266 60/39.821 |
| 8,407,892 B2 | 4/2013 | DiCintio et al. | | |

(Continued)

FOREIGN PATENT DOCUMENTS

| | | |
|---|---|---|
| EP | 1 443 190 A1 | 8/2004 |
| EP | 2 660 519 A1 | 11/2013 |

OTHER PUBLICATIONS

Extended European Search Report and Opinion issued in connection with corresponding EP Application No. 17197848.9 dated Mar. 21, 2018.

*Primary Examiner* — Scott J Walthour

(74) *Attorney, Agent, or Firm* — Dority & Manning, P.A.

(57) ABSTRACT

A combustor assembly includes a combustion liner defining a first radial opening, an outer sleeve that at least partially surrounds the combustion liner. The outer sleeve defines a second radial opening. A mounting body having a jacket portion and a flange portion surrounds the first radial opening and extends radially outwardly from an outer surface of the combustion liner towards the outer sleeve. The flange portion is at least partially disposed within the second radial opening. An auxiliary component extends radially within the jacket portion and includes a flange portion. The flange portion of the auxiliary component is connected to the flange portion of the mounting body via a first fastener, and the flange portion of the auxiliary component is connected to the outer sleeve via a second fastener.

18 Claims, 5 Drawing Sheets

(56) References Cited

U.S. PATENT DOCUMENTS

| | | | | |
|---|---|---|---|---|
| 8,919,137 | B2 | 12/2014 | DiCintio et al. | |
| 9,010,120 | B2 | 4/2015 | DiCintio et al. | |
| 2006/0096091 | A1* | 5/2006 | Carrier | B23K 20/129 29/889.2 |
| 2010/0212324 | A1* | 8/2010 | Bronson | F02C 7/264 60/752 |
| 2012/0297785 | A1* | 11/2012 | Melton | F23R 3/02 60/772 |
| 2013/0031783 | A1* | 2/2013 | DiCintio | F23R 3/06 29/890.02 |
| 2016/0047317 | A1 | 2/2016 | Willis et al. | |
| 2018/0112875 | A1 | 4/2018 | Daniel | |

* cited by examiner

COMBUSTOR ASSEMBLY WITH MOUNTED AUXILIARY COMPONENT

FIELD

The present invention generally involves a combustor assembly. More specifically, the invention relates to a combustor assembly for a gas turbine engine.

BACKGROUND

A gas turbine engine generally includes a compressor section, a combustion section, and a turbine section. The combustion section typically includes at least one combustor which includes a combustion liner positioned within a combustor casing. The combustion liner may be circumferentially surrounded by a sleeve such as an impingement sleeve and/or a flow sleeve. The sleeve is radially spaced from the combustion liner and a flow or cooling passage is defined therebetween.

In particular configurations, an axially staged fuel injector extends radially through the sleeve and the combustion liner downstream from a fuel nozzle. During operation of the combustor, the liner and the sleeve both expand and contract at different rates as the combustor cycles through various thermal conditions and as such, there is relative motion between these components. In addition, there is relative movement between the combustion liner, the sleeve and the axially staged fuel injector. This relative motion may result in leakage between a high pressure plenum surrounding the sleeve and/or the flow passage and a hot gas path defined within the combustion liner and/or may result in undesirable mechanical stresses between the axially staged fuel injector and at least one of the sleeve and the combustion liner.

BRIEF DESCRIPTION

Aspects and advantages are set forth below in the following description, or may be obvious from the description, or may be learned through practice.

One embodiment of the present disclosure is a combustor assembly. The combustor assembly includes a combustion liner defining a first radial opening and an outer sleeve that at least partially surrounds the combustion liner and that defines a second radial opening. A mounting body having a jacket portion and a flange portion surrounds the first radial opening and extends radially outwardly from an outer surface of the combustion liner towards the outer sleeve. The flange portion is at least partially disposed within the second radial opening. An auxiliary component extends radially within the jacket portion and includes a flange portion. The flange portion of the auxiliary component is connected to the flange portion of the mounting body via a first fastener, and the flange portion of the auxiliary component is connected to the outer sleeve via a second fastener.

Another embodiment of the present disclosure is a combustor. The combustor includes an end cover that is coupled to an outer casing. A fuel nozzle extends axially downstream from the end cover. The combustor also includes a combustion liner that defines a combustion zone downstream from the fuel nozzle and that defines a first radial opening that is axially offset from the fuel nozzle. An outer sleeve at least partially surrounds the combustion liner. The outer sleeve defines a second radial opening. The combustor also includes a mounting body having a jacket portion and a flange portion. The jacket portion surrounds the first radial opening and extends radially outwardly from an outer surface of the combustion liner towards the outer sleeve. The flange portion is at least partially disposed within the second radial opening. An auxiliary component, which extends radially within the jacket portion, includes a flange portion. The flange portion of the auxiliary component is connected to the flange portion of the mounting body via a first fastener, and the flange portion of the auxiliary component is connected to the outer sleeve via a second fastener.

Those of ordinary skill in the art will better appreciate the features and aspects of such embodiments, and others, upon review of the specification.

BRIEF DESCRIPTION OF THE DRAWINGS

A full and enabling disclosure of the of various embodiments, including the best mode thereof to one skilled in the art, is set forth more particularly in the remainder of the specification, including reference to the accompanying figures, in which.

DETAILED DESCRIPTION

Figure 1:
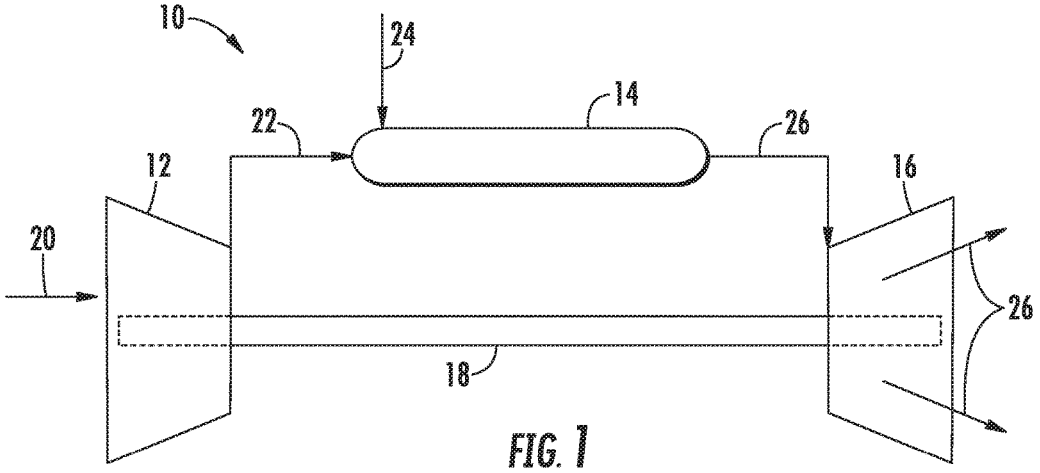
FIG. 1 is a functional block diagram of an exemplary gas turbine that may incorporate various embodiments of the present disclosure.

Reference will now be made in detail to present embodiments of the disclosure, one or more examples of which are illustrated in the accompanying drawings. The detailed description uses numerical and letter designations to refer to features in the drawings. Like or similar designations in the drawings and description have been used to refer to like or similar parts of the disclosure.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. The term "radially" refers to the relative direction that is substantially perpendicular to an axial centerline of a particular component, the term "axially" refers to the relative direction that is substantially parallel and/or coaxially aligned to an axial centerline of a particular component, and the term "circumferentially" refers to the relative direction that extends around the axial centerline of a particular component.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Each example is provided by way of explanation, not limitation. In fact, it will be apparent to those skilled in the art that modifications and variations can be made without departing from the scope or spirit thereof. For instance, features illustrated or described as part of one embodiment may be used on another embodiment to yield a still further embodiment. Thus, it is intended that the present disclosure covers such modifications and variations as come within the scope of the appended claims and their equivalents. Although exemplary embodiments of the present disclosure will be described generally in the context of a combustor for a land based power generating gas turbine for purposes of illustration, one of ordinary skill in the art will readily appreciate that embodiments of the present disclosure may be applied to any style or type of combustor for a turbomachine and are not limited to combustors or combustion systems for land based power generating gas turbines unless specifically recited in the claims.

Referring now to the drawings, FIG. 1 illustrates a schematic diagram of an exemplary gas turbine 10. The gas turbine 10 generally includes a compressor 12, at least one combustor 14 disposed downstream of the compressor 12 and a turbine 16 disposed downstream of the combustor 14. Additionally, the gas turbine 10 may include one or more shafts 18 that couple the compressor 12 to the turbine 16.

During operation, air 20 flows into the compressor 12 where the air 20 is progressively compressed, thus providing compressed or pressurized air 22 to the combustor 14. At least a portion of the compressed air 22 is mixed with a fuel 24 within the combustor 14 and burned to produce combustion gases 26. The combustion gases 26 flow from the combustor 14 into the turbine 16, wherein energy (kinetic and/or thermal) is transferred from the combustion gases 26 to rotor blades (not shown), thus causing shaft 18 to rotate. The mechanical rotational energy may then be used for various purposes such as to power the compressor 12 and/or to generate electricity. The combustion gases 26 may then be exhausted from the gas turbine 10.

Figure 2:
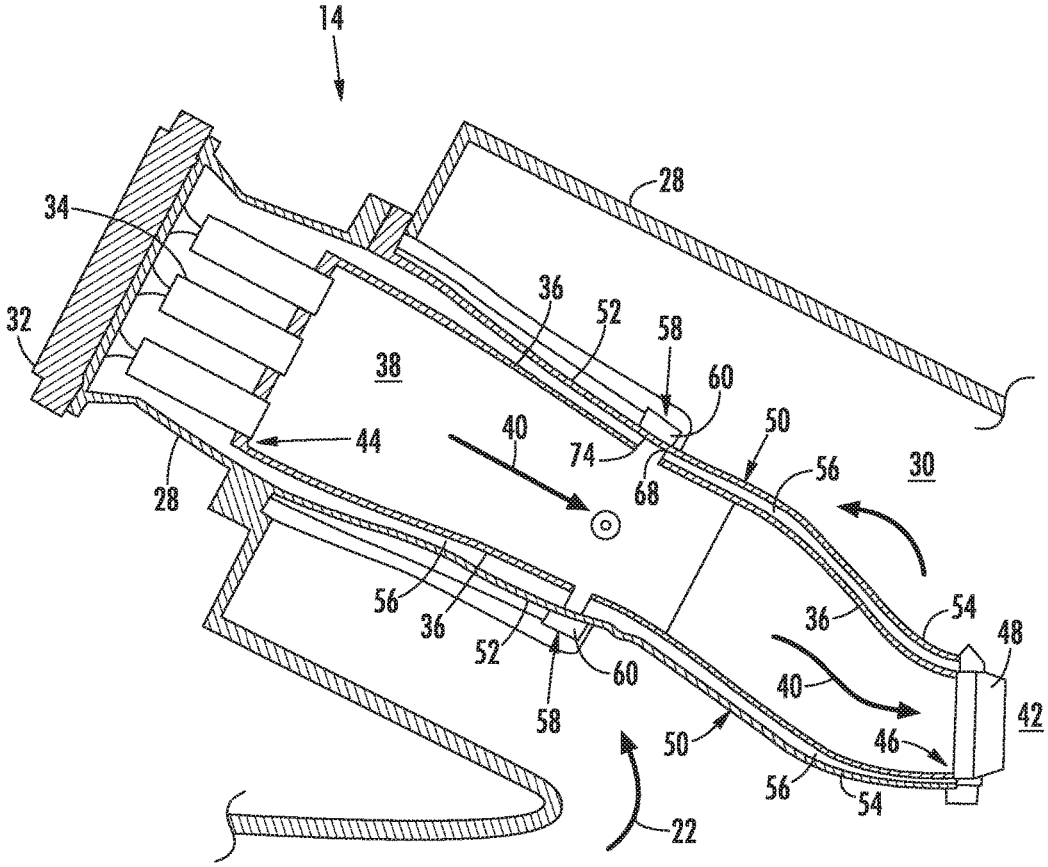
FIG. 2 is a simplified cross-section side view of an exemplary combustor as may incorporate various embodiments of the present disclosure.

FIG. 2 provides a cross-sectioned side view of an exemplary combustor as may incorporate various embodiments of the present disclosure. As shown in FIG. 2, the combustor 14 may be at least partially surrounded by an outer casing 28 such as a compressor discharge casing. The outer casing 28 may at least partially define a high pressure plenum 30 that at least partially surrounds various components of the combustor 14. The high pressure plenum 30 may be in fluid communication with the compressor 12 (FIG. 1) so as to receive a portion of the compressed air 22 therefrom. An end cover 32 may be coupled to the outer casing 28. One or more fuel nozzles 34 may extend axially downstream from the end cover 32.

One or more combustion liners or ducts 36 may at least partially define a combustion chamber or zone 38 downstream from the one or more fuel nozzles 34 and/or may at least partially define a hot gas path 40 through the combustor 14 for directing the combustion gases 26 (FIG. 1) towards an inlet 42 to the turbine 16. In particular embodiments, the combustion liner 36 may be formed from a singular body or unibody having an upstream or forward end 44 of the combustion liner 36 that is substantially cylindrical or round. The combustion liner 36 may then transition to a non-circular or substantially rectangular cross-sectional shape proximate to a downstream or aft end 46 of the combustion liner 36.

In particular embodiments, the aft end 46 of the combustion liner 36 may terminate at an aft frame 48. The aft frame 48 may be used to mount the combustion liner 36 to the outer casing 28 or to other support hardware, thereby fixing or axially restraining the aft end 46 of the combustion liner 36. As such, the forward end 44 of the combustion liner 36 may expand and contract axially towards the one or more fuel nozzles 34 as the combustor 14 transitions through various thermal conditions.

In particular embodiments, the combustion liner 36 is at last partially circumferentially surrounded by an outer sleeve 50. The outer sleeve 50 may be formed as a single component or formed by multiple sleeve segments such as by a flow sleeve 52 and an impingement sleeve 54. The impingement sleeve 54 is slideably engaged with the flow sleeve 52 to allow for axial relative movement therebetween. The outer sleeve 50 is radially spaced from the combustion liner 36 so as to define a cooling flow passage 56 therebetween. The outer sleeve 50 may define a plurality of inlets or holes (not shown) which provide fluid communication between the cooling flow passage 56 and the high pressure plenum 30. In particular embodiments, the outer sleeve 50 may be generally or substantially unrestrained in the axial direction with respect to an axial centerline of the combustor 14. As such, the outer sleeve 50 may expand and contract axially towards the one or more fuel nozzles 34 and/or towards the aft frame 48 as the combustor 14 transitions through various thermal conditions.

In various embodiments, as shown in FIG. 2, the combustor 14 includes at least one auxiliary penetration or component 58 axially offset from and disposed downstream from the fuel nozzle(s) 34. The auxiliary component(s) 58 may include any component having a body that extends radially through the outer sleeve 50, the cooling flow passage 56 and at least partially through the combustion liner 36. For example, the auxiliary component 58 may include a spark igniter, a sensor, a probe or other combustion hardware device. In particular embodiments, the auxiliary component 58 comprises a fuel injector 60 axially offset from and disposed downstream from the fuel nozzle(s) 34. In particular embodiments, the combustor 14 includes a plurality of fuel injectors 60 annularly arranged about the combustion liner 36 and the outer sleeve 50. Each fuel injector 60 extends radially through the outer sleeve 50, the cooling flow passage 56 and at least partially through the combustion liner 36. Each fuel injector 60 provides a secondary fuel and air mixture to the hot gas path defined within the combustion liner 36 downstream from the fuel nozzle(s) 34 and/or the combustion zone 38.

Figure 3:
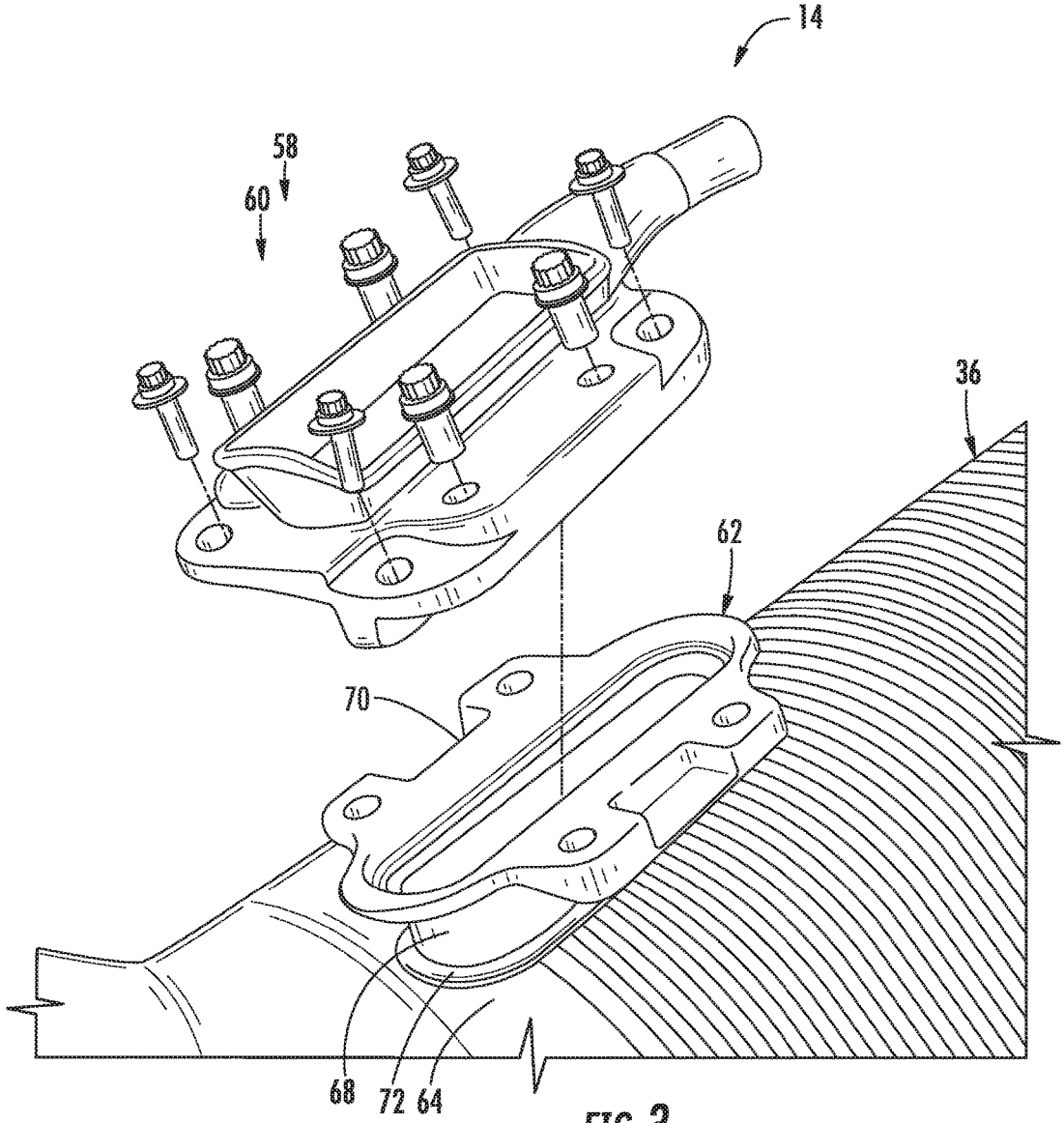
FIG. 3 is a perspective view of a portion of an exemplary combustor according to at least one embodiment of the present disclosure.
Figure 4:
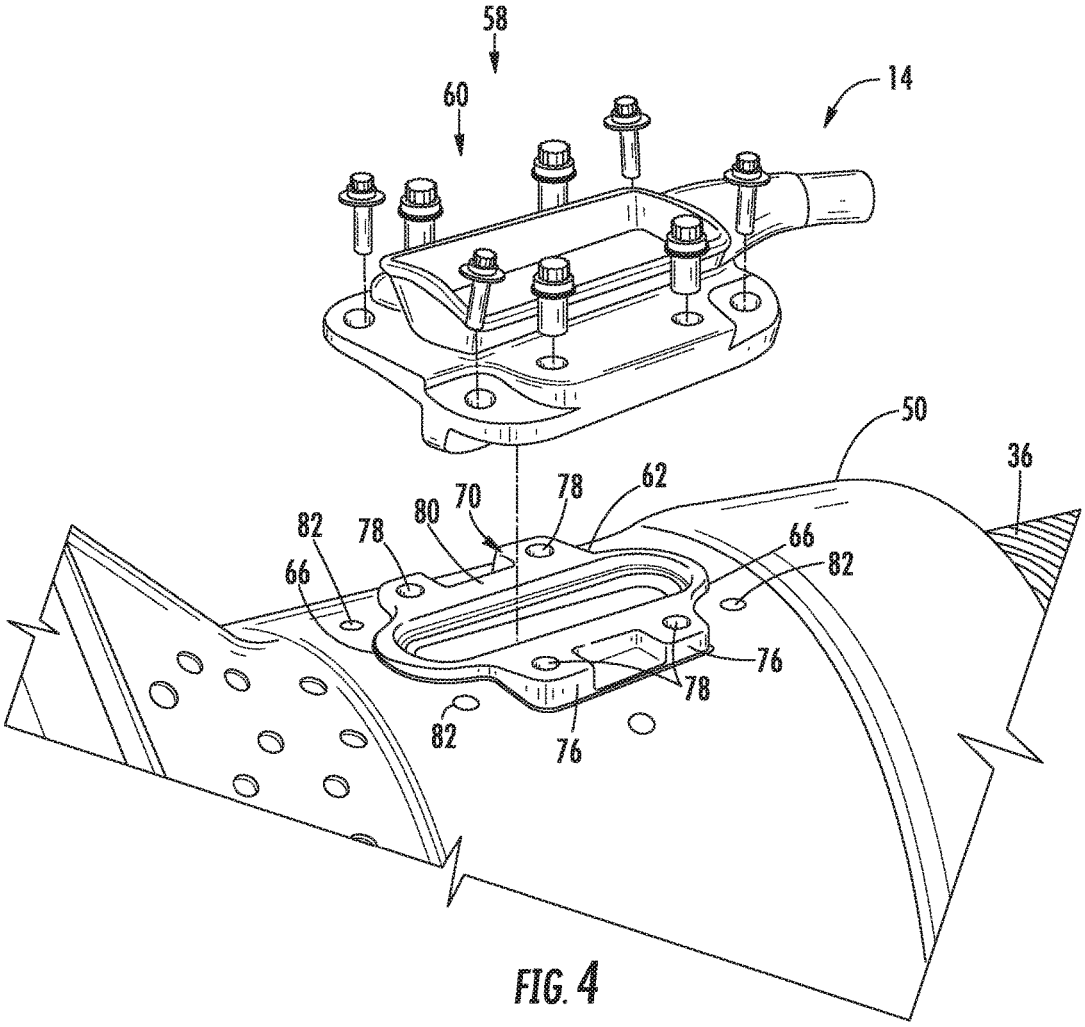
FIG. 4 is a perspective view of a portion of the combustor as shown in FIG. 3, according to at least one embodiment of the present disclosure.

FIG. 3 provides a perspective view of a portion of the combustor 14 with the outer sleeve 50 removed for clarity and including a portion of the combustion liner 36 and an exemplary auxiliary component 58 or fuel injector 60 exploded away from the combustion liner 36 according to at least one embodiment of the present disclosure. FIG. 4 provides a perspective view of a portion of the combustor 14 as shown in FIG. 3, including the outer sleeve 50 according to at least one embodiment of the present disclosure. As shown in FIGS. 3 and 4 collectively, a mounting body 62 extends radially outwardly from an outer surface 64 of the combustion liner 36 and through a radial opening 66 defined in and/or by the outer sleeve 50. In various embodiments, as shown in FIG. 3, the mounting body 62 includes a jacket or sleeve portion 68 and a flange portion 70. A first end 72 of the jacket portion 68 is fixedly connected to or formed as part of the combustion liner 36. The jacket portion 68 circumferentially surrounds a radial opening 74 (FIG. 2) defined in and/or by the combustion liner 36. In particular embodiments, the jacket portion 68 forms a seal around the radial opening 74 of the combustion liner 36. As shown in FIG. 2, the jacket portion 68 extends radially outwardly from the combustion liner 36 and at least partially through the cooling flow passage 56.

As shown in FIG. 4, the flange portion 70 of the mounting body 62 extends through the radial opening 66 of the outer sleeve 50. The radial opening 66 may be sized so that a gap or clearance is defined between an outer perimeter or perimeter wall 76 of the flange portion 70 and the radial opening 66. In various embodiments, as shown in FIG. 4, the flange portion 70 defines a plurality of fastener openings 78 disposed along an outer surface 80 of the flange portion 70. The fastener openings 78 may be threaded or may include threaded inserts (not shown). The outer sleeve 50 defines a plurality of holes 82. In particular embodiments, the location of the holes 82 may be outboard of the perimeter wall 76.

Figure 5:
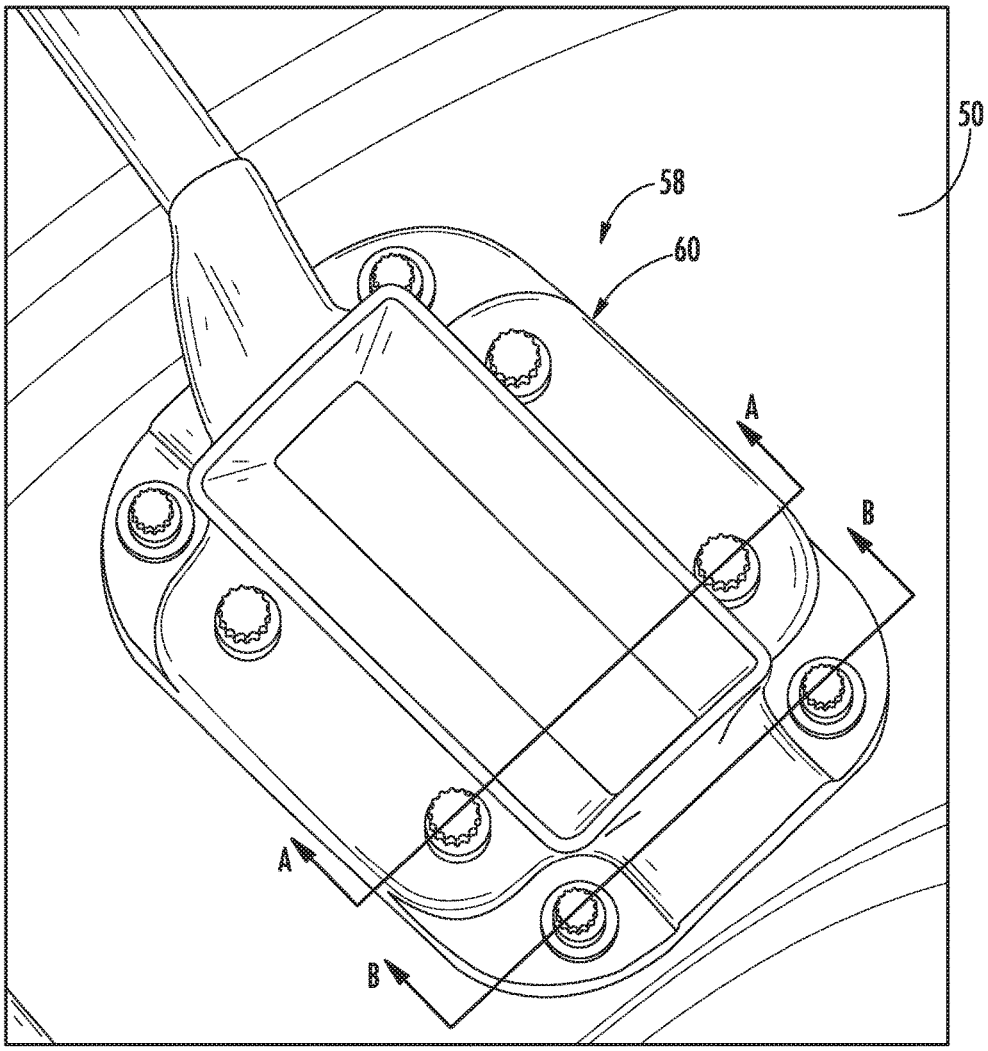
FIG. 5 is a perspective view of an exemplary auxiliary component mounted to a mounting body and to an outer sleeve of the combustor according to at least one embodiment of the present disclosure.
Figure 6:
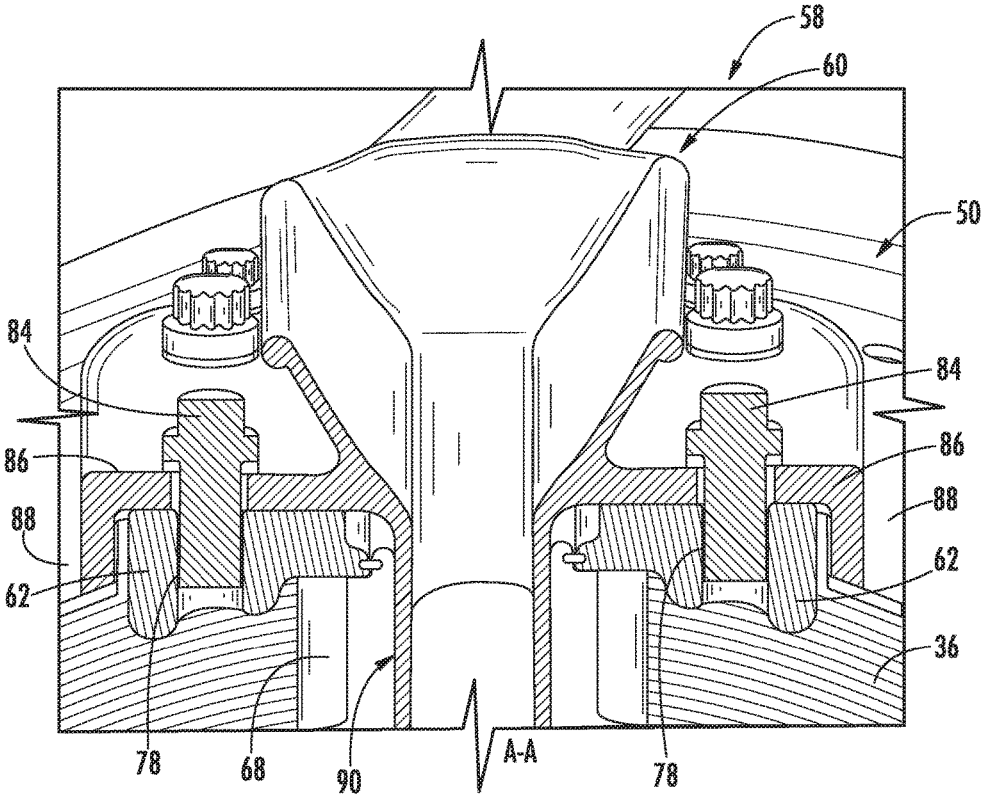
FIG. 6 provides a cross-sectioned front view taken along section lines A-A as shown in FIG. 5 and illustrates the auxiliary component of FIG. 5 coupled to the mounting body according to one embodiment of the present disclosure.
Figure 7:
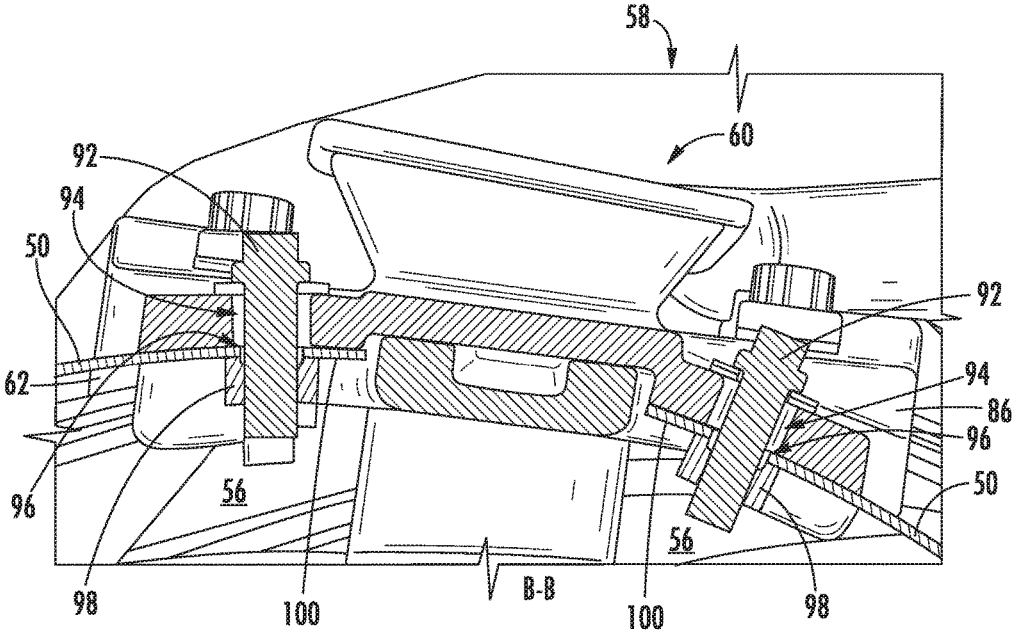
FIG. 7 provides a cross-sectioned front view taken along section lines B-B as shown in FIG. 5 and illustrates the auxiliary component of FIG. 5 coupled to the outer sleeve according to one embodiment of the present disclosure.

FIG. 5 provides a perspective view of the exemplary auxiliary component 58 or fuel injector 60 mounted to the mounting body (not shown) and to the outer sleeve 50 according to at least one embodiment of the present disclosure. FIG. 6 provides a cross-sectioned front view taken along section lines A-A as shown in FIG. 5 and illustrates the auxiliary component 58 or fuel injector 60 coupled to the mounting body 62 according to one embodiment of the present disclosure. FIG. 7 provides a cross-sectioned front view taken along section lines B-B as shown in FIG. 5 and illustrates the auxiliary component 58 or fuel injector 60 coupled to the outer sleeve 50 according to one embodiment of the present disclosure.

As shown in FIG. 6, at least one fastener 84 extends through a flange portion 86 of the auxiliary component 58 or fuel injector 60 and into a corresponding fastener opening 78 of the flange portion 70 of the mounting body 62, thereby fixedly connecting the auxiliary component 58 or fuel injector 60 to the mounting body 62 and as such to the combustion liner 36. In particular embodiments, as shown in FIG. 6, the flange portion 86 of the auxiliary component 58 or fuel injector 60 may extend radially inwardly towards an outer surface 88 the outer sleeve 50 and in particular embodiments, may make contact with or seal against the outer surface 88. In particular embodiments, as shown in FIG. 6, a radially extending portion 90 of the auxiliary component 58 or fuel injector 60 extends radially inwardly from the flange portion 70 of the mounting body 62 within the jacket portion 68 towards the hot gas path 40 (FIG. 2).

As shown in FIG. 7, at least one fastener 92 extends through a slotted or elongated opening or hole 94 defined by the flange portion 86 of the auxiliary component 58 or fuel injector 60 and through a corresponding hole 96 of the outer sleeve 50. The fastener 92 may be threaded into a corresponding boss 98 disposed along an inner surface 100 of the outer sleeve 50, thereby fixedly connecting the auxiliary component 58 or fuel injector 60 to the outer sleeve 50. The fastener 92 may be tightened in such a fashion to secure the auxiliary component 58 or fuel injector 60 to the outer sleeve 50.

As a result, the outer sleeve 50 may grow thermally from the auxiliary component 58 or fuel injector 60 in both a forward axial direction towards the fuel nozzle(s) 34 and in an aft axial direction towards the aft frame 48. In particular embodiments, the fastener 92 may be tightened in such a fashion to form at least a partial seal between the flange portion 86 of the auxiliary component 58 or fuel injector 60 and the outer surface 88 of the outer sleeve 50, thereby preventing or reducing air leakage around the auxiliary component 58 or fuel injector 60 into the cooling flow passage 56. Such an assembly represents an improvement over the prior art.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A combustor assembly, comprising:

a combustion liner defining a first radial opening;

an outer sleeve at least partially surrounding the combustion liner, the outer sleeve defining a second radial opening;

a mounting body having a jacket and a flange, wherein the jacket surrounds the first radial opening and extends radially outwardly from an outer surface of the combustion liner towards the outer sleeve, wherein the flange is at least partially disposed within the second radial opening; and an auxiliary component that extends radially within the jacket, the auxiliary component having a flange, wherein the flange of the auxiliary component is directly connected to the flange of the mounting body via a first fastener, and wherein the flange of the auxiliary component is directly connected to the outer sleeve via a second fastener.

2. The combustor assembly as in claim 1, wherein the outer sleeve is radially spaced from the combustion liner and defines a flow passage therebetween, and wherein the jacket of the mounting body is disposed within the flow passage.

3. The combustor assembly as in claim 1, wherein the auxiliary component is a fuel injector.

4. The combustor assembly as in claim 1, wherein a gap is defined between a perimeter wall of the flange of the mounting body and the second radial opening of the outer sleeve.

5. The combustor assembly as in claim 1, further comprising a boss disposed along an inner surface of the outer sleeve, wherein the second fastener directly connecting the flange of the auxiliary component to the outer sleeve is threaded into the boss.

6. The combustor assembly as in claim 1, wherein the flange of the auxiliary component forms a seal against an outer surface of the outer sleeve.

7. The combustor assembly as in claim 1, wherein the outer sleeve comprises at least one of a flow sleeve and an impingement sleeve.

8. The combustor assembly as in claim 1, wherein the auxiliary component, the outer sleeve and the combustion liner are rigidly connected together by the first fastener and the second fastener.

9. A combustor, comprising:

an end cover coupled to an outer casing;

a fuel nozzle extending axially downstream from the end cover;

a combustion liner defining a combustion zone downstream from the fuel nozzle, the combustion liner defining a first radial opening axially offset from the fuel nozzle;

an outer sleeve at least partially surrounding the combustion liner, the outer sleeve defining a second radial opening, wherein the second radial opening is aligned with the first radial opening;

a mounting body having a jacket and a flange, wherein the jacket surrounds the first radial opening and extends radially outwardly from an outer surface of the combustion liner towards the outer sleeve, wherein the flange is at least partially disposed within the second radial opening; and an auxiliary component that extends radially within the jacket, the auxiliary component having a flange, wherein the flange of the auxiliary component is directly connected to the flange of the mounting body via a first fastener, and wherein the flange of the auxiliary component is directly connected to the outer sleeve via a second fastener.

10. The combustor as in claim 9, wherein the outer sleeve is radially spaced from the combustion liner and defines a flow passage therebetween, and wherein the jacket of the mounting body is disposed within the flow passage.

11. The combustor as in claim 9, wherein the auxiliary component comprises a fuel injector.

12. The combustor as in claim 9, wherein the auxiliary component comprises a spark igniter.

13. The combustor as in claim 9, wherein the auxiliary component comprises a sensor or a probe.

14. The combustor as in claim 9, wherein a gap is defined between a perimeter wall of the flange of the mounting body and the second radial opening of the outer sleeve.

15. The combustor as in claim 9, further comprising a boss disposed along an inner surface of the outer sleeve, wherein the second fastener directly connecting the flange of the auxiliary component to the outer sleeve is threaded into the boss.

16. The combustor as in claim 9, wherein the flange of the auxiliary component forms a seal against an outer surface of the outer sleeve.

17. The combustor as in claim 9, wherein the outer sleeve comprises at least one of a flow sleeve and an impingement sleeve.

18. The combustor as in claim 9, wherein the auxiliary component, the outer sleeve and the combustion liner are rigidly connected together by the first fastener and the second fastener.

* * * * *